US007475641B2

(12) United States Patent
Jin

(10) Patent No.: US 7,475,641 B2
(45) **Date of Patent: *Jan. 13, 2009**

(54) FOLDING TABLE

(75) Inventor: Ju-Young Jin, Fujian (CN)

(73) Assignee: Lifetime Products, Inc., Clearfield, UT (US)

( * ) Notice: Subject to any disclaimer, the term of this patent is extended or adjusted under 35 U.S.C. 154(b) by 1399 days.

This patent is subject to a terminal disclaimer.

(21) Appl. No.: 10/616,800

(22) Filed: Jul. 10, 2003

(65) Prior Publication Data

US 2004/0094076 A1 May 20, 2004

(51) Int. Cl.
*A47B 3/00* (2006.01)

(52) U.S. Cl. ..... 108/132; 108/35

(58) Field of Classification Search ..... 108/129, 108/132, 171, 172, 173, 174, 115, 35, 36, 108/167, 168, 169; 297/158.4, 17, 159.1
See application file for complete search history.

(56) References Cited

U.S. PATENT DOCUMENTS

| | | | |
|---|---|---|---|
| 429,458 | A | 6/1890 | Kraemer |
| 493,441 | A | 3/1893 | Munz |
| 643,511 | A | 2/1900 | Lloyd |
| 1,614,187 | A | 1/1927 | Coggins |
| 1,639,367 | A | 8/1927 | Seward |
| 1,765,766 | A | 6/1930 | Lyon |
| 1,907,111 | A | 5/1933 | Holland et al. |
| 1,976,140 | A | 10/1934 | Paul |
| 2,542,394 | A | 2/1951 | Cohen et al. |
| 2,619,394 | A | 11/1952 | Mahr |
| 2,730,418 | A | 1/1956 | Blink |
| 2,747,957 | A | 5/1956 | Lencioni |
| 2,871,076 | A | 1/1959 | Mell |
| 2,872,259 | A | 2/1959 | Thorpe |
| 3,143,982 | A | 8/1964 | Blink et al. |
| 3,368,504 | A | 2/1968 | Cohen |
| 3,415,208 | A | 12/1968 | Thoresen et al. |
| 3,656,439 | A | 4/1972 | Domin |
| 3,731,971 | A | 5/1973 | Sjogren |
| 3,823,938 | A | 7/1974 | Unno |

(Continued)

OTHER PUBLICATIONS

U.S. Appl. No. 12/042,250, filed Mar. 4, 2008, Larcom.

*Primary Examiner*—José V Chen
(74) *Attorney, Agent, or Firm*—Workman Nydegger

(57) ABSTRACT

A folding table is disclosed having a two-stage folding mechanism. The folding table includes a table top divided into a first planar portion and a second planar portion. A pair of side rails is connected to each planar portion. A foldable leg and support brace is connected to each planar portion. A hinge assembly is provided disposed between the first planar portion and the second planar portion. The hinge assembly includes a hinge pin, a first hinge connector and a second hinge connector rotatably disposed on the hinge pin. The first hinge connector has a cam portion. A locking pin is disposed through a slot in the second hinge connector so that when the locking pin is positioned nearest the hinge axis, the cam portion abuts the locking pin, thus locking the table top. When the locking pin is positioned farthest from the hinge axis, the first hinge connector is able to freely rotate about the hinge axis. A lock actuating mechanism may be used to operate the locking pin and may provide an anchoring or reinforcing mechanism to maintain the locking pin in a locked position.

27 Claims, 7 Drawing Sheets

U.S. PATENT DOCUMENTS

| | | | | |
|---|---|---|---|---|
| 3,866,913 | A | 2/1975 | Zimmers et al. | |
| 4,005,898 | A | 2/1977 | Way | |
| D247,080 | S | 1/1978 | Robinson | |
| 4,089,522 | A | 5/1978 | Rock | |
| 4,133,271 | A | 1/1979 | Carlson | |
| 4,489,661 | A | 12/1984 | Fitzgerald | |
| 4,567,835 | A | 2/1986 | Reese et al. | |
| 4,653,804 | A | 3/1987 | Yoo et al. | |
| 4,841,877 | A | 6/1989 | Virtue | |
| 4,883,314 | A | 11/1989 | Sakong | |
| 4,911,085 | A | 3/1990 | Pencoske | |
| 5,009,170 | A | 4/1991 | Spehar | |
| 5,154,441 | A | 10/1992 | White et al. | |
| 5,357,872 | A | 10/1994 | Wilmore | |
| 5,377,601 | A | 1/1995 | Cashen | |
| 5,421,272 | A | 6/1995 | Wilmore | |
| 5,501,157 | A | 3/1996 | Westerburgen | |
| 5,730,066 | A | 3/1998 | Auten et al. | |
| D414,626 | S | 10/1999 | Collins et al. | |
| 5,983,807 | A | 11/1999 | Tarnay et al. | |
| 6,000,345 | A | 12/1999 | Gillotti | |
| D420,527 | S | 2/2000 | Pinch | |
| 6,032,585 | A | 3/2000 | Pinch | |
| 6,058,853 | A | 5/2000 | Pinch | |
| 6,112,674 | A | 9/2000 | Stanford | |
| 6,454,357 | B1 | 9/2002 | Foulger | |
| D468,135 | S | 1/2003 | Ashby et al. | |
| D479,778 | S | 9/2003 | Haney et al. | |
| D489,557 | S | 5/2004 | Strong et al. | |
| 6,905,166 | B2 * | 6/2005 | Zhurong et al. | 297/158.4 |
| 7,063,025 | B2 | 6/2006 | Ashby et al. | |
| 7,278,361 | B2 | 10/2007 | Zhurong et al. | |
| 7,299,753 | B2 | 11/2007 | Strong | |
| 2002/0092445 | A1 | 7/2002 | Glover et al. | |
| 2004/0094076 | A1 | 5/2004 | Jin | |
| 2004/0187749 | A1 | 9/2004 | Zhurong et al. | |
| 2005/0241550 | A1 | 11/2005 | Neunzert et al. | |

* cited by examiner

FOLDING TABLE

CROSS-REFERENCE TO RELATED APPLICATIONS

This application claims priority to Chinese Patent Application Serial No. 02263076.7, filed on Jul. 10, 2002, and entitled "A Folding Table," which application is incorporated herein by reference in its entirety.

BACKGROUND OF THE INVENTION

1. Field of the Invention

The present invention relates to folding tables. In particular, the present invention relates to a folding table having a novel collapse and locking system to provide compact folding of the table for better storage, mobility and/or transportability.

2. Background

In order to increase the practical utility of existing furniture, whether household furniture or office furniture, there are continually increasing demands on their function. For example, tables are known to support all types of activity such as reading, writing, drawing, crafts, projects, holding and storing items, and the like. However, when not in use, a table can become inconvenient, especially in locations where the space is needed for other activities. For this reason, folding tables have developed. By providing a folding mechanism, tables can be collapsed for easier transportation and storage. Advantageously, this allows tables to be stored vertically or horizontally and placed in, for example, a storage closet or against a wall.

Various mechanisms for folding a table have been developed. For example, FIG. 1 shows a folding table that can be used for various indoor and outdoor activities. The folding table is comprised primarily of a table top 10 and a support assembly 12. The support assembly 12 a pair of side rails 16, a pair of cross bars 18 positioned at opposing ends of the table, and a pair of legs 20. Additionally, two support braces 22 may be coupled to the table top 10 and legs 20. The two legs 20 are pivotally attached to the table top. As such, when it is desired to store the table, legs 20 are brought inward until they are placed substantially parallel to table top 10. Advantageously, this reduces the space required to store the table. However, in a conventional folding table such as the one shown in FIG. 1, the area of the table top is fixed so that it is only possible to fold the legs 20 while there is no way to fold the table top 10.

There are many situations where it would be desirable to have a table of a size comparable to the table shown in FIG. 1. Camping and traveling are some examples. However, transporting the table of FIG. 1, even in its folded state, becomes unreasonable. For one thing, a conventional folding table does not easily fit in the trunk or backseat of a car. A person may be required to get a larger vehicle or attach a trailer to their vehicle if they desire to transport the conventional folding table.

Furthermore, there are limited spaces in a persons' house or property where they can store a conventional folding table, even in its folded state. Often, a person must store the table upright against a wall, which can sometimes be dangerous. If the table is stored horizontally, the table takes up space which might be used for other objects. It would thus be an advantage to provide a folding table which provides the table top size comparable to a conventional folding table, but which requires less space for storage.

In addition, a conventional folding table is generally unwieldy for a single person to transport, even in its folded state. Transporting a large folding table can sometimes be dangerous if the person is too small to lift the table by themselves. It would thus be an advantage to provide a folding table which, in its most folded state, provides a structure which is easily lifted and carried by a single person.

Additionally, when a conventional folding table is in a folded position, the folded legs structures are exposed which may catch on other objects or cause potential injury to a person who may come in contact with the exposed structures.

Thus, it would be an advantage to provide a table which has a large enough table top to provide the area needed for most activities, but which provides a compact structure which is easily lifted and transported.

SUMMARY OF THE INVENTION

The objective of the present invention is to provide a folding table, the table top of which can be compactly folded so that space can be effectively saved after it has been folded. The folding tables include a table top, a support assembly to hold the table top upright, and a hinge assembly configured to allow the table top to fold.

The folding tables of the present invention generally include a rectangular table top. The table top may be configured in any suitable shape desired for the particular uses of the table, including, but not limited to, circular, square, oblong, and the like. The table top has a first end and a second end. The table top further includes a top surface and an opposing bottom surface extending between the first end and the second end.

The table top is divided into a first planar portion and a second planar portion. That is, an imaginary transverse plane intersects the table top at a point between the first end and the second end to divide the table top into the first planar portion and second planar portion. Each of the planar portions has an interior edge which faces the other. Each planar portion also has an outer edge extending around the periphery thereof. The interior edges of the planar portions are configured to matingly engage so that the seam formed between the planar portions when the table top is unfolded is as minimal as possible. A lip may extend downwardly from the outer edges of the planar portions. The lip may be configured to attach to portions of the support assembly and also to hide portions of the support assembly.

The table top is selectively positionable between a working position and a storage position. In the working position, the interior edges of each planar portion are positioned so that they interface with each other and are not exposed to the exterior. In the storage position, in contrast, the interior edges of the planar portions do not interface such that they are exposed to the exterior similar to the outer edges.

The support assembly includes two pairs of spaced-apart side rails connected to the first and second planar portions, a leg coupled to each of the pair of side rails, and a support brace coupled to each leg to assist in maintaining each leg in the extended position.

In more detail, the first planar portion includes a pair of spaced-apart side rails coupled thereto. The second planar portion also has a pair of spaced-apart side rails coupled thereto. Each side rail has an interior end and an exterior end. The side rails have one or more apertures formed transversely through the exterior end thereof. The side rails are configured to connect to the legs of the support assembly at the exterior ends. At the interior end of the side rails, is disposed a channel or aperture or other structure for coupling the side rails to the hinge assembly.

In one embodiment, each leg includes two leg members, a cross bar disposed at the proximal end of the leg members, and a cross bar transversely disposed between and joining the leg members at a point along the length thereof. The proximal end of the legs is pivotally coupled to the planar portions. In one embodiment, the crossbars located at the proximal ends of the legs are pivotally coupled to apertures located at the exterior ends of the side rails. As such, the legs are able to be selectively positioned between an extended position and a folded position.

A first support brace is connected to the first leg, and a second support brace is connected to the second leg. Each brace includes a V-shaped swivel portion, an extension portion and a base portion. In one embodiment, the base portion is coupled to the hinge assembly. The swivel portion is coupled to the legs. Each swivel portion includes a first swivel arm and a second swivel arm. A bracing ring may be slidably disposed over the extension portion to rest over the joint of the swivel arms and the extension portion. The swivel portion of the support brace allows that portion of the support brace to fully extend when the leg is fully extended, and to rotate inward to fold back onto the extension portion into a compact structure when the leg is folded. As such, the support brace is selectively positionable between an extended position and a folded position simultaneously with the operation of the legs.

The hinge assembly is configured to allow a user to selectively position and maintain the table top between a working position and a storage position. The hinge assembly is disposed between the first planar portion and the second planar portion of the table top. In one embodiment, one hinge assembly is placed at each end of the interface between the first planar position and the second planar portion. At least one hinge assembly has a locking mechanism which allows the table top to be locked in a working position.

The hinge assembly includes a hinge pin which is disposed under the bottom surface of the table top in the imaginary transverse plane dissecting the table top. The longitudinal axis of the hinge pin forms a hinge axis about which the table top folds between the working and the storage positions. In one embodiment, the hinge pin for both of the hinge assemblies on either side of the table top may be the same structure.

The hinge assembly also includes a first hinge connector and a second hinge connector. The first hinge connector includes a body and a connector portion. The body is configured to couple to a side rail or other structure of the first planar portion. The connector portion of the first hinge connector includes one or more webs extending from the body. Each web has a substantially circular configuration. One or both webs include a hook or cam portion at the end thereof. Along the length of the connector portion is one or more apertures configured to receive the end of a structure of a support brace. The web(s) of the connector portion also include one or more apertures configured to receive an end of the hinge pin.

The second hinge connector includes a body and a connector portion. The body is configured to couple to a side rail or other structure on the second planar portion. The body has substantially the same configuration as the body of the first hinge connector. The connector portion of the second hinge connector includes one or more webs extending from the body. Each web has a substantial circular configuration. The connector portion of the second hinge connector has one or more apertures configured to receive an end of a structure of a support brace. In addition, the connector portion includes one or more apertures configured to receive an end of the hinge pin. The connector portion of the second hinge connector also includes one or more elongate locking slots configured to receive a locking pin.

The locking pin and locking slots cooperate with the cam portion of the first hinge connector to form the locking mechanism. In operation, the first hinge connector and second hinge connector are pivotally disposed about the hinge pin in opposing directions. The locking pin is disposed through the locking slot(s). The selective positioning of the locking pin within the locking slot(s) dictates the status of the locking mechanism.

In the locked position, the locking pin is displaced in the locking slot(s) closest to the hinge axis. When the locking pin is in the locked position, the cam portion of the first hinge connector abuts against the locking pin. Thus, the first hinge connector is unable to rotate with respect to the hinge axis. This prevents the table top from folding together. In the unlocked position, the locking pin is placed in the locking slot(s) in the position farthest away from the hinge axis. In this position, the cam portion is not impeded by the locking pin such that the first hinge connector can freely rotate about the hinge axis. The table top is thus rotatable such that it may be folded from the working position to a storage position. The table top is only impeded in its rotation by the limit created when the interior edges of the first and second planar portions meet.

In one embodiment, the selective positioning of the locking pin between the locked and unlocked position can be performed manually. In another embodiment, a lock actuating mechanism is employed. The lock actuating mechanism may comprise a lever which has a connector portion rotatably disposed about the hinge axis and a handle portion at the opposing end. The lock actuating mechanism may also include an anchoring portion. The lock actuating mechanism includes a displacement slot which is disposed at an offset angle with respect to the locking slot(s) when the lock actuating mechanism is included as part of the hinge assembly.

The displacement slot of the lock actuating mechanism functions to move the locking pin within the locking slot(s). That is, the movement of the handle of the lock actuating mechanism displaces the locking pin within the locking slot (s) from the locked position to the unlocked position. This is due to the offset angles of the displacement slot and the locking slot(s).

The lock actuating mechanism also includes an anchoring portion which is an elongate structure that extends outwardly from the handle. The anchoring portion includes a first groove and a second groove. The grooves are shaped to substantially conform to the outer surface of a structure of a support brace to engage the support brace in the two different groove positions. In the locked position, the second groove engages the support brace. In the unlocked position, the first groove engages the support brace. As such, the lock actuating mechanism is reinforced such that it assists to maintain or anchor the locking pin in the locking slot(s).

In view of the foregoing, the folding tables of the present invention employ a two-stage folding process to provide an enhanced compact folding structure. That is, the folding table can be collapsed from a fully working structure to a folded, compact structure. In the first stage, a folding table begins in an upright position in which the support assembly maintains the table top in an upright fashion. In this position, the first and second planar portions are substantially aligned with each other to provide a working surface. The table is turned upside down to provide greater access to the support assembly. The legs and support braces are folded from an extended position to a folded position.

In the second stage, the hinge assembly is manually or otherwise unlocked such that the cam portion of the first hinge connector does not contact the locking pin. The first planar portion and second planar portion of the table top are thus able to rotate about the hinge axis to fold the table top. In the second stage, the support assembly also folds in half to be disposed within the halves of the table top. As such, a highly compact structure is provided which provides ease of storage.

The folded tables of the present invention may be stored in storage spaces which were not suitable for conventional folding tables, such as closets, trunks of cars or backseats of cars. The folded table provides a more compact structure which is easier for a person to carry and transport. In addition, the folded table allows a table which has the size of a conventional folding table to be used in activities which has not heretofore been possible. Finally, the folded table protects users when in its folded state by housing structures of the support assembly so that they are not exposed.

Those skilled in the art will recognize that the embodiments of the present invention are not limited to the embodiments disclosed in this summary. These and other objects and features of the present invention will become more fully apparent from the following description and appended claims, or may be learned by the practice of the invention as set forth hereinafter.

DETAILED DESCRIPTION OF THE PREFERRED EMBODIMENTS

I. Introduction

Figure 1:
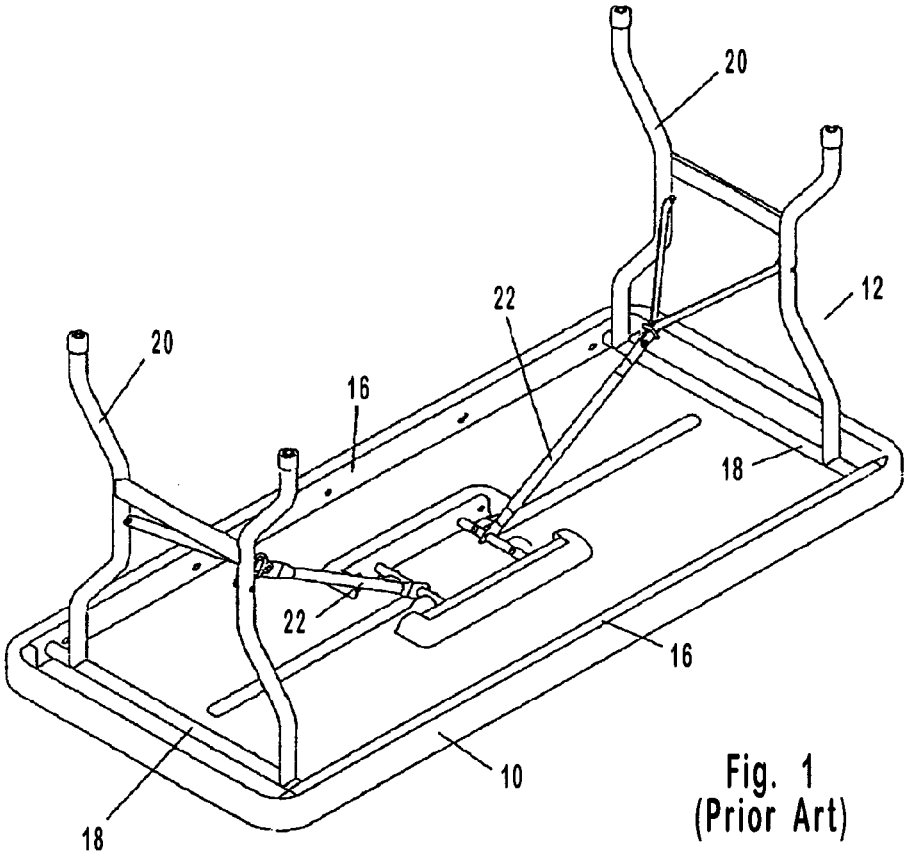
Fig. 1 (Prior Art)
FIG. 1 is a schematic diagram of a conventional folding table.
Figure 2:
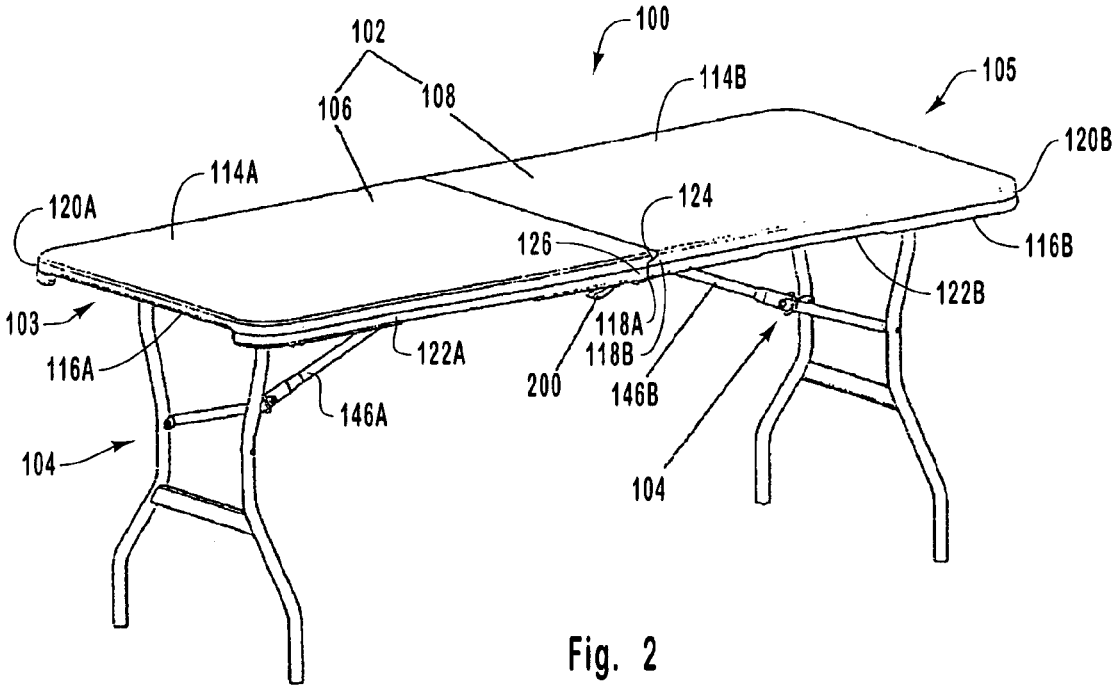
FIG. 2 is a perspective view of a one embodiment of a folding table of the present invention.

The present invention is directed to folding tables. In particular, the folding tables of the present invention have a two-stage folding mechanism which results in a highly compact structure. With reference to FIG. 2, a table 100 is shown having a table top 102 and a support assembly 104 configured to hold the table top upright. Table 100 is configured to fold into a highly compact structure, shown best in FIG. 5.

Figure 4:
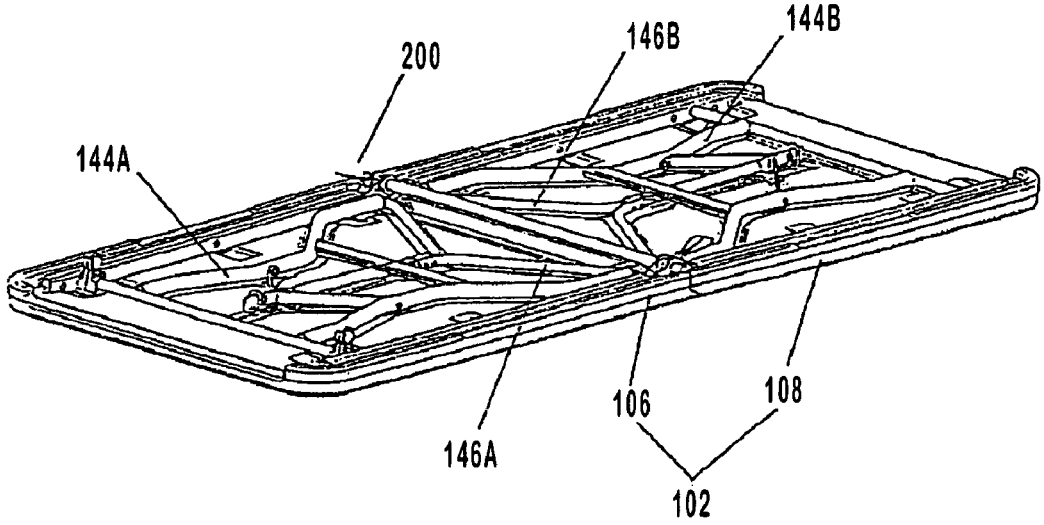
FIG. 4 is a perspective view of the folding table of FIG. 2 showing one stage of folding of the tables of the present invention.
Figure 5:
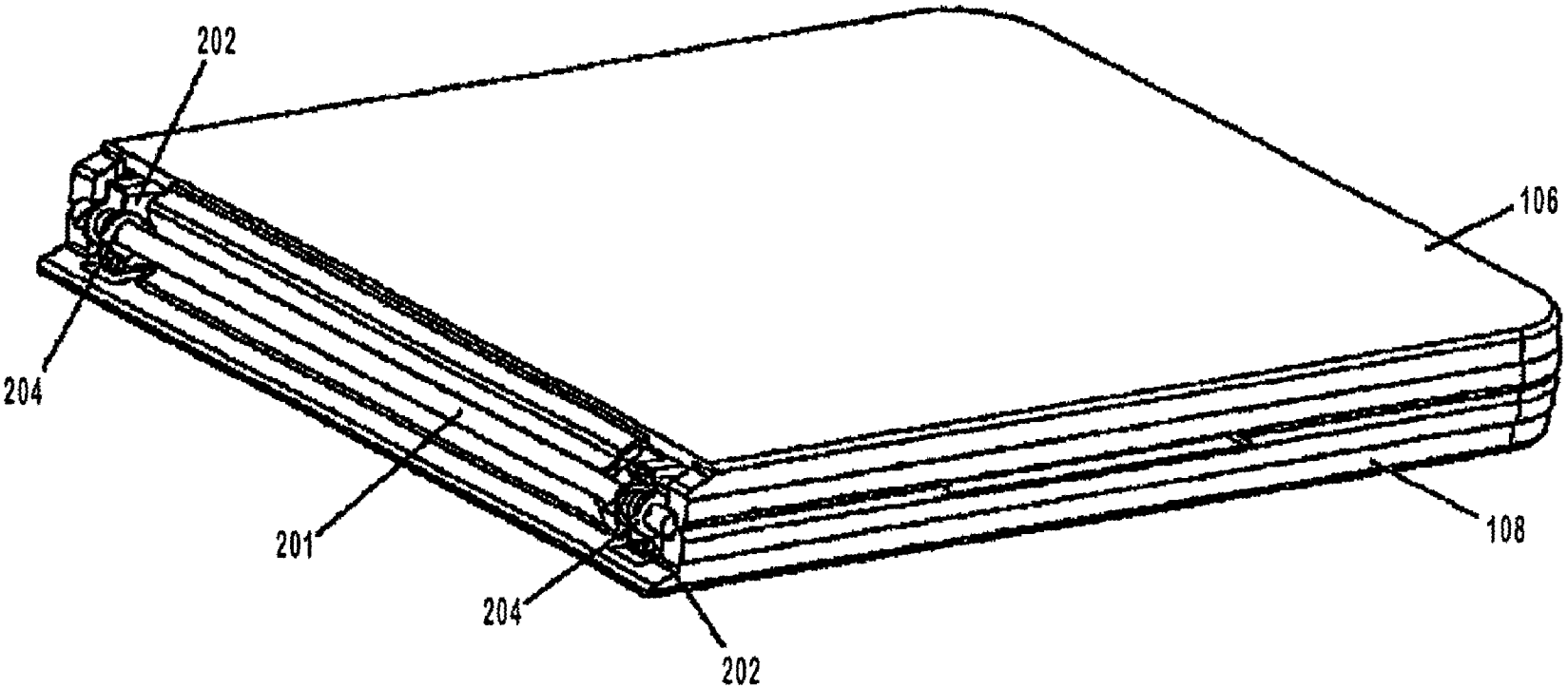
FIG. 5 is a perspective view of the folding table of FIG. 2 showing a second stage of folding of the tables of the present invention.

Generally, to go from the configuration of FIG. 2 to that of FIG. 5, a two-stage folding mechanism is used which provides the enhanced compactness of the folded table of FIG. 5. In the first stage, as will be discussed in further detail below, the support assembly 104 is selectively positionable between an extended position (FIG. 2) and folded position (FIG. 4). In the second stage, after support assembly 104 is folded, table top 102 is selectively positionable between a working position (FIG. 4) and a storage position (FIG. 5). Note that support assembly 104 also undergoes enhanced folding in which the support assembly is folded in half and disposed entirely within the folded portions of the table top. A hinge assembly 200 is provided for allowing table top 102 to be positioned between the working position and storage position and to securely maintain table top 102 in the working position without folding unexpectedly.

As used herein, the terms "extended," "folded," "working" and "storage" are used to refer to specific folding configurations of table 100 and not to particular uses of the table. For example, the term "working" when used to indicate that table top 102 is unfolded does not infer that portions of table top 102 cannot be used when in the "storage" position. In fact, in the "storage" position, table 100 may actually be useful for various purposes such as to provide a hard work surface upon which to write, to provide a surface on which to store other objects, and the like.

Accordingly, the present invention provides for a compact structure that takes up less space than a conventional folding table. In the embodiment of FIG. 5, the table takes up half of the area as the structure of a corresponding conventional folding table that does not have the additional folding utility of the present invention. These and other features of the folding tables of the present invention will now be discussed in detail.

II. Foldable Table Top

Figure 3:
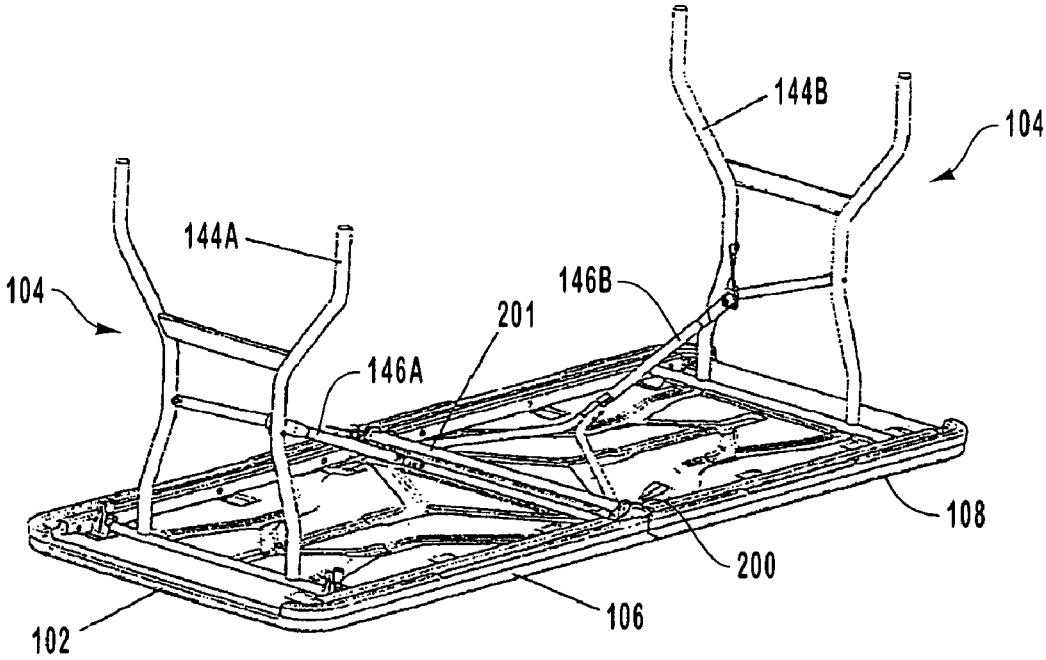
FIG. 3 is a perspective view of the folding table of FIG. 2 in an upside-down position.

With reference to FIGS. 2 and 3, table 100 includes a rectangular table top 102. Table top 102 may be configured in any shape suitable for the particular uses of table 100 including, but not limited to, circular, square, oblong, and the like. Table top 102 has a first end 103 and a second end 105. Table top 102 further includes a top surface 114 and an opposing bottom surface 116 extending between first end 103 and second end 105. As shown in FIG. 3, bottom surface 116 may have various depressions or grooves to receive portions of support assembly 104.

As shown in FIG. 2, table top 102 is divided into a first planar portion 106 and a second planar portion 108. That is, an imaginary transverse plane (not shown) intersects table top 102 at a point between first end 103 and second end 105 to divide the table top 102 into planar portions 106, 108. In one embodiment, the plane intersects table top 102 at equidistant points from first end 103 and second end 105 so that planar portions 106, 108 have equal areas. However, planar portions 106, 108 can be formed to have different sizes. In addition, table top 102 may be divided into more than two portions to provide an even more compact structure.

In the embodiment of FIG. 2, table top 102 is divided into two equal planar portions 106, 108, with each portion having similar elements, which elements are referred to herein with like reference numerals. The notation "A" is used to indicate those elements which are found on the side of the first planar portion 106 and "B" to refer to those elements located on the side of the second planar portion 108. Thus, each planar portion 106, 108 includes a top surface 114A, 114B and an opposing bottom surface 116A, 116B. Planar portions 106, 108 are configured so that each has an interior edge 118A, 118B, respectively. Planar portions 106, 108 also have an outer edge 120A, 120B extending around the outer periphery thereof which cooperate to form the outer edge of table top 102.

Interior edges 118A, 118B of planar portions 106, 108 are configured to matingly engage so that the seam formed between planar portions 106, 108 when table top 102 is unfolded is as minimal as possible. In one embodiment, interior edges 118A, 118B are flat so that the surfaces thereof matingly engage. In another embodiment, illustrated in FIG. 2, one of the planar portions 106, 108 may have an upper tenon 124 while the other of the portions has a lower tenon 126 such that the upper tenon and lower tenon matingly engage when the table top 102 is unfolded. Other configurations using tenons, mortises, grooves, ridges, and the like may be designed to provide optimal interfacing and engagement between first and second planar portions 106, 108.

Planar portions 106, 108 include lips 122A, 122B extending downwardly from the outer edges 120A, 120B thereof. Portions of support assembly 104 may be attached to downwardly extending lips 122A, 122B. For example, portions of support assembly 104 may be attached to an inner surface of the downwardly extending lips 122A, 122B by one or more fasteners. It will be understood that other suitable means or methods for attaching the support assembly 104 to the table top 102 may be employed, including, but not limited to, rivets, screws, bolts, glues, epoxies, or other bonding materials. The height of the inner surface of the lips 122A, 122B is preferably generally equal to or greater than the height of side rails of the support assembly 104 (discussed below) so that the side rails are generally hidden from view when the table 100 is viewed from a plane generally aligned with the upper surface 114 of table top 102. Advantageously, because portions of support assembly 104 may be completely or generally hidden from view, portions of support assembly 104 do not have to be finished and may contain visible imperfections or flaws. In addition, because portions of support assembly 104 may be completely or generally hidden from view by lips 122A, 122B, a more aesthetically pleasing table 100 may be created. It will be appreciated, however, that lips 122A, 122B do not have to hide portions of support assembly 104.

Table top 102 can be constructed of any material which provides sufficient strength for the purposes for which table 100 is intended. Table top 102 may also be constructed from a lightweight material which allows the table 100 to be easily transported. In one embodiment, table top 102 can be constructed out of plastic such as, but not limited to, blow molded plastic or injection molded plastic. Other suitable materials include, but are not limited to wood and metal.

As discussed above, table top 102 is selectively positionable between a working position (FIG. 4) and a storage position (FIG. 5). In the working position, the interior edges 118A, 118B of planar portions 106, 108 are positioned such that they interface with each other and are not exposed to the exterior. In contrast, in the storage position, the interior edges 118A, 118B of planar portions 106, 108 do not interface, such that they are exposed to the exterior similar to outer edges 120A, 120B. The folding of table top 102 is part of the second stage of the two-stage folding mechanism described above.

III. Foldable Support Assembly

Figure 6:
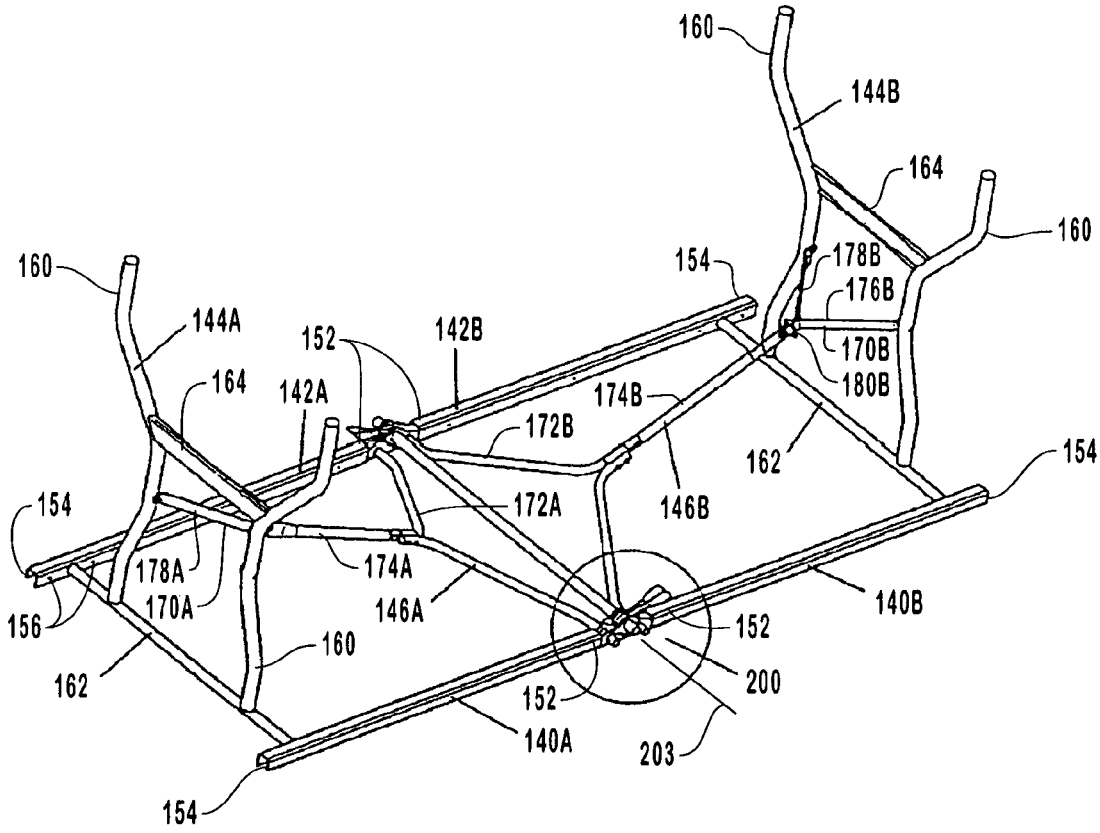
FIG. 6 is a perspective view of the support assembly and hinge assembly of the folding table of FIG. 2.
Figure 7:
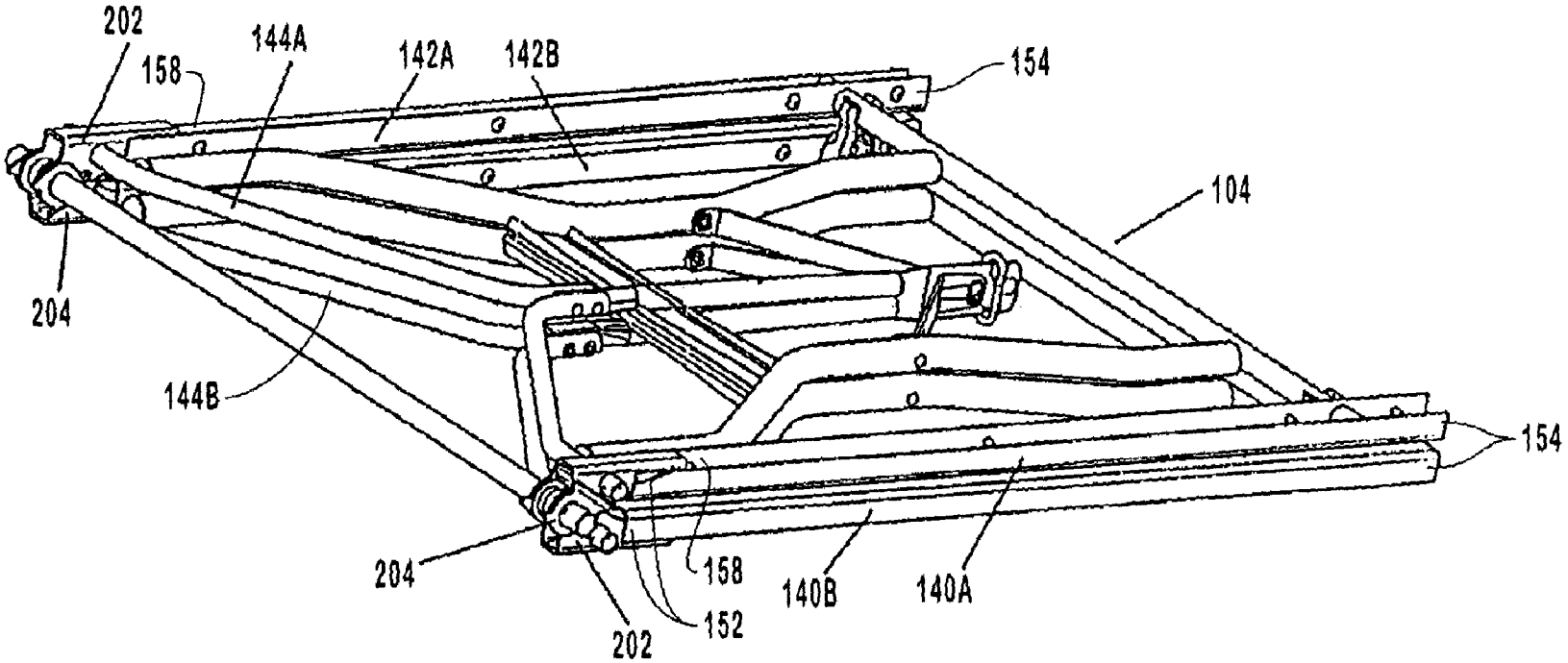
FIG. 7 is a perspective view of the support assembly and hinge assembly of FIG. 6 showing the second stage of folding for those components.

Turning now to FIGS. 3, 6 and 7, support assembly 104 will be described in further detail. Support assembly 104 includes two pairs of spaced apart side rails 140A, 142A and 140B, 142B connected to first and second planar portions 106, 108. Support assembly 104 also includes a pair of legs 144A, 144B coupled to the side rails. A pair of braces 146A, 146B assists to bold legs 144A, 144B upright. As such, legs 144A, 144B are selectively positionable between an extended position (FIG. 3) and a folded position (FIG. 4).

In more detail, first planar portion 106 includes a pair of spaced apart side rails 140A, 142A. Second planar portion 108 has a pair of spaced apart side rails 140B, 142B. Side rails 140, 142 have an interior end 152 and an exterior end 154. Side rails 140, 142 have one or more apertures 156 formed transversely through the exterior end 152 thereof. Side rails 140, 142 are configured to connect to legs 144A, 144B at the exterior ends 154 via apertures 156.

In one embodiment, side rails 140, 142 are preferably hollow members. For example, as shown in FIG. 7, side rails 140, 142 may be elongate U or C-shaped members. Side rails 140, 142 may have any suitable cross-section including, but not limited to, square, circular, ovate, polygonal, and the like. In the embodiment where side rails 140, 142 are hollow, the side rails have an aperture 158 formed at the interior end 152 thereof. In the embodiment where side rails 140, 142 are elongate U or C-shaped members, they have a channel 158 formed at the interior end 152 thereof. Side rails 140, 142 are configured to connect to hinge assembly 200 at the interior end thereof via aperture or channel 158. Alternatively, side rails 140, 142 can be constructed as solid members. Side rails 140, 142 are preferably constructed of a high strength material such as, but not limited to, plastic and metals.

In one embodiment, side rails 140, 142 may be formed integrally with first and second planar portions 106, 108 of table top 102. For example, side rails 140, 142 may be formed integrally with their respective planar portions 106, 108 during an injection molding process. Appropriate apertures or channels may be formed during or after the manufacturing process in order to couple portions of support assembly 104 thereto.

In the embodiment of FIG. 6, each leg 144A, 144B includes two leg members 160, a cross bar 162 disposed at the proximal end of the leg members, and a cross bar 164 transversely extending between and joining the leg members at a point along the length thereof. In FIG. 6, leg members 160 are curved; however, leg members 160 could also be straight. Furthermore, two leg members 160 are not necessary; each leg 144A, 144B may be constructed with a single leg member 160. In embodiments where a single leg member 160 is present, cross bar 164 is not required. The components of legs 144A, 144B are preferably hollow to decrease the weight of support assembly 104 and, ultimately, table 100. In addition, components of legs 144A, 144B are preferably constructed of a high-strength material such as metal or plastic.

First leg 144A is pivotally coupled to first planar portion 106 and second leg 144B is pivotally coupled to second planar portion 108. In the embodiment of FIG. 6, cross bars 162 of legs 144A, 144B are coupled to apertures 156 located at exterior ends 154 of side rails 140, 142. Cross bars 162 of legs 144A, 144B are pivotally connected to side rails 140, 142 while legs 144A, 144B are rigidly connected to cross bars 162 of legs 144A, 144B. Preferably, cross bars 162 have a circular cross-section so that they may be pivotally disposed in apertures 156.

In another embodiment, cross bars 162 could be rigidly connected to side rails 140, 142 while legs 144A, 144B are pivotally connected to cross bars 162. In still another embodiment, legs 144A, 144B might not have cross bars 162 and have only the leg members 160 pivotally coupled to side rails 140, 142. In yet another embodiment, side rails 140, 142 might not be present and legs 144A, 144B might be pivotablly coupled directly to planar portions 106, 108. Importantly, legs 144A, 144B are able to be selectively positioned between an extended position (FIG. 3) and a folded position (FIG. 4).

A first support brace 146A is connected to first leg 144A and a second support brace 146B is connected to second leg 144B. In more detail, first support brace 146A includes a V-shaped swivel portion 170A and a base portion 172A. An extension portion 174A is disposed between swivel portion 170A and base portion 172A. Base portion 172A is a V-shaped member, the ends thereof being coupled to hinge assembly 200. In another embodiment, base portion 172A could be coupled to side rails 140A, 142A. In yet another embodiment, base portion 172A could be coupled directly to first planar portion 106. In still another embodiment, base portion 172A could be eliminated and extension portion 174A elongated and pivotally coupled to side rails 140A, 142A or planar portion 106.

Swivel portion 170A includes a first swivel arm (not shown, but otherwise referred to herein as first swivel arm 176A) and a second swivel arm 178A. Swivel arms 176A, 178A have one end pivotally coupled to extension portion 174A and a second end pivotally coupled to a leg member 160 of leg 144A. A bracing ring 180A may be slidably disposed over extension portion 174A.

As such, support brace 146A is selectively positionable between an extended position (FIG. 3) and a folded position (FIG. 4) simultaneous with the operation of leg 144A. In the extended position, swivel arms 176A, 178A extend outwardly to allow leg 144A to unfold to the fullest extent possible. Bracing ring 180A may be placed over the joint of swivel arms 176A, 178A and extension portion 174A. In the folded position, swivel arms 176A, 178A pivot inwardly, doubling over so that they lie substantially parallel with extension portion 174A. In this manner, support brace 146A is able to compactly fold so that the support brace 146A can be contained within the perimeter of table top 102.

Second support brace 146B is configured substantially similarly to first support brace 146A so corresponding elements are referred to with like reference numbers, substituting "A" for "B" because these elements correspond to planar portion 108. Second support brace 146B is also able to compactly fold in a manner mirroring that of first support brace 146A, as shown in FIG. 4.

The folding of support assembly 104 between an extended position and a storage position is considered as the first stage of the folding mechanism of the present invention. The support assembly 104 is also able to fold as part of the second stage of the folding mechanism. As shown in FIG. 7, in the second stage, the support assembly 104 which has been placed in the storage position is folded in half about the hinge assembly 200. This allows for a compactly folded support assembly 104 which is able to fit within the periphery of the folded portions 106, 108 of table top 102.

IV. Hinge Assembly

Turning now to FIGS. 8-9 and 10-11, hinge assembly 200 will now be discussed in detail. Hinge assembly 200 is configured to allow a user to selectively position and maintain table top 102 between a working position (FIG. 4) and a storage position (FIG. 5). In the working position, planar portions 106, 108 of table top 102 are aligned on the same plane such that planar portions 106, 108 cooperate to form the composite table top 102. In this position, both planar portions 106, 108 are usable as a workable surface. In the folded position, planar portions 106, 108 are arranged such that the bottom surfaces 116A, 116B thereof face each other. In this position, only one of planar portions 106, 108 is potentially usable as a workable surface.

In the embodiment of FIG. 6, two hinge assemblies 200 are implemented, both having a locking mechanism—one hinge assembly is disposed between side rails 140A, 140B and the other between side rails 142A, 142B. This may be preferable to balance the torque forces experienced by the hinge assemblies 200 when folding and unfolding table top 102. However, in another embodiment, two hinge assemblies 200 are used where only one has a locking mechanism. In yet another embodiment, only one hinge assembly 200 is used, that hinge assembly having a locking mechanism. For purposes of discussing the hinge assembly 200, only one hinge assembly will be described with the understanding that the same description and scope applies to other hinge assemblies that may be applied in embodiments of the present invention.

Hinge assembly 200 includes a hinge pin 201. Hinge pin 201 is disposed under bottom surface 116 of table top 102 and in the imaginary transverse plane dissecting table top 102. The longitudinal axis of hinge pin 201 thus forms a hinge axis 203 about which table top 102 folds between the working and storage positions. Hinge pin 201 preferably has a structure and composition which is able to withstand the torque forces experienced by hinge assembly 200 during folding of table top 102. In some embodiment, hinge pin 201 may be a solid, cylindrical member. In other embodiments, hinge pin 201 may be hollow provided that it has sufficient strength to withstand such forces. In some embodiment, lips 122A, 122B include one or more grooves or apertures configured to receive the ends of hinge pin 201 to cover the ends thereof. While hinge pin 201 is shown as a single elongate member, hinge pin 201 may be divided so that a hinge pin 201 corresponds to each hinge assembly 200.

Figure 8:
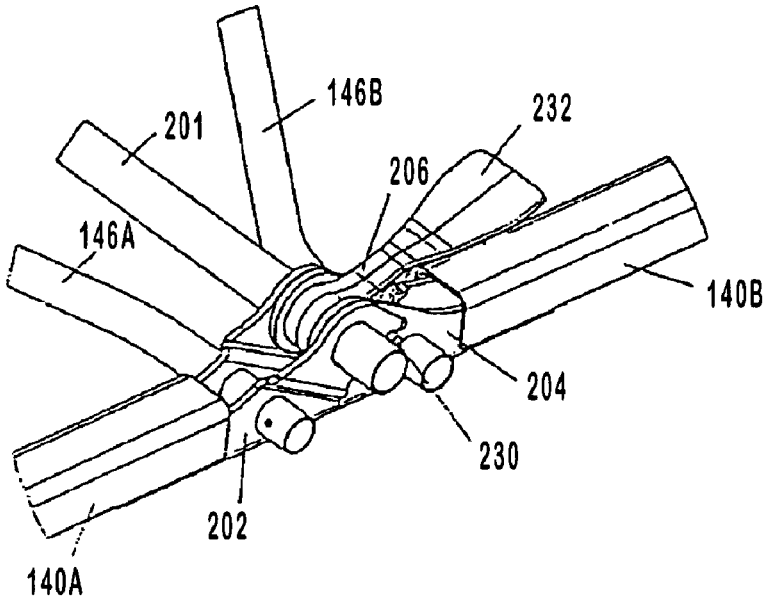
FIG. 8 is a perspective view focusing on the hinge assembly of the present invention.
Figure 9:
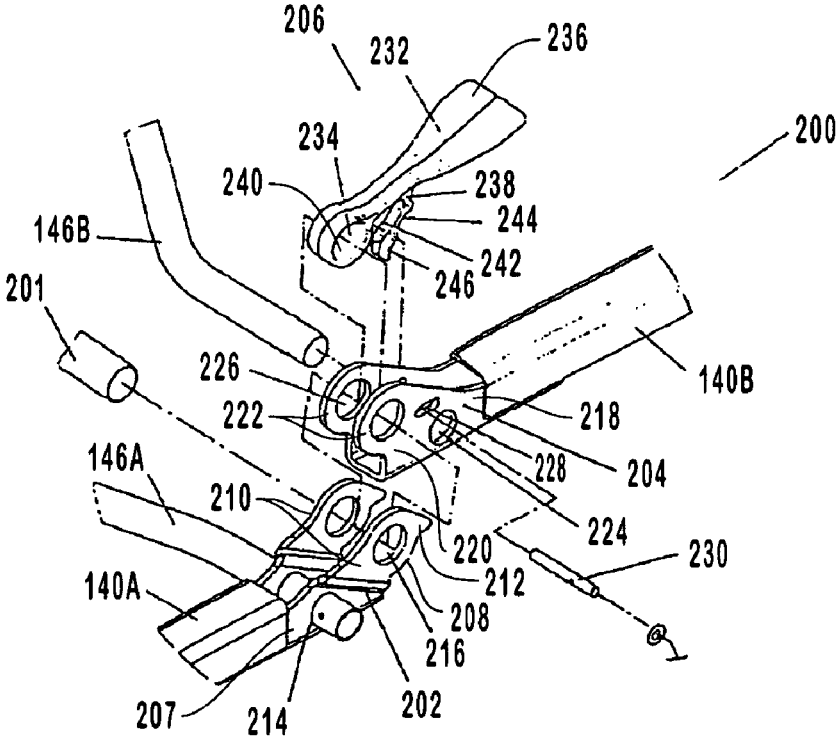
FIG. 9 is an exploded view of the hinge assembly of FIG. 8.

As shown in FIGS. 8 and 9, hinge assembly 200 includes a first hinge connector 202, a second hinge connector 204, and a lock actuating mechanism 206. The hinge axis 203 forms the axis of rotation for table 100. Both portions 106, 108 of table top 102 rotate about hinge axis 203. In addition, first and second hinge connectors 202, 204 and lock actuating mechanism 206 rotate about hinge axis 203. Connectors 202, 204 and lock actuating mechanism 206 operate to securely allow table top 102 to be selectively positioned between a working position and a storage position, thus providing enhanced compactness desirable for storage and/or transportation purposes.

First hinge connector 202 includes a body 207 and a connector portion 208. Body 207 is configured to couple with side rail 140A. In the embodiment of FIG. 8, body 207 is a U-shaped or C-shaped member having one end configured to fit within aperture 158 of side rail 140A. Where side rail 140A is also a U or C-shaped member, body 207 fits inside or outside of side rail 140A and can be coupled thereto by means such as welding, soldering, rivets, screws, bolts, glues, epoxies, or other bonding material. Preferably, a tight clearance fit between body 207 and side rail 140A is preferred in order to relieve and transfer some of the torque experienced by hinge assembly 200. In another embodiment where side rails 140A are solid, body 207 of first hinge connector 202 may have another suitable shape configured to attach to side rail 140A by other means such as rivets, screws, bolts, glues, epoxies, or other bonding materials.

Connector portion 208 of first hinge connector 202 includes two parallel wings or webs 210 extending from body 207. Each web 210 has a substantially circular configuration. However, one or both webs 210 also include a hook or cam portion 212 at the end thereof. Along the length of connector portion 208 is a pair of apertures 214 configured to receive an end of support brace 146A. Apertures 214 allow support brace 146A to be pivotally disposed therethrough. In one embodiment, only a single aperture 214 may be provided to allow support brace 146A to be coupled to first hinge connector 202. As discussed above, apertures 214 are not necessary where support brace 146A connects directly to side rails 140, 142 or where the side rails are integrally formed with table top 102 and support brace 146A is configured to directly connect thereto. However, apertures 214 may be provided in first hinge connector 202 where it is more convenient to form connecting structures in the separate structural component provided by first hinge connector 202. In addition, as shown best in FIG. 9, webs 210 of connector portion 208 includes a pair of apertures 216 configured to receive an end of hinge pin 201. Preferably, apertures 214, 216 are circular in cross-section to allow corresponding circular cross-sectioned structures of support brace 146A and hinge pin 201 to pivot therein.

The structure of second hinge connector 204 is similar to that of first hinge connector 202. Second hinge connector 204 includes a body 218 and a connector portion 220. Body 218 is configured to couple with side rail 140B. Body 218 has substantially the same configuration as body 207 of first hinge connector 202. Connector portion 220 of second hinge connector 204 includes two parallel wings or webs 222 extending from body 218. Each web 222 has a substantially circular configuration. However, webs 222 may be configured with a cam portion similar to that of first hinge connector 202 if desired for ease of manufacturing purposes. That way, only one manufacturing mold need be developed.

Connector portion 220 has a pair of apertures 224 configured to receive an end of support brace 146B. As discussed above, apertures 224 are not necessary where support brace 146B connects directly to side rails 140, 142 or where siderails are integrally formed with table top 102 and support brace 146B is configured to directly connect thereto. In addition, connector portion 220 includes a pair of apertures 226 configured to receive an end of hinge pin 201. Preferably, apertures 224, 226 are circular in cross-section to allow corresponding circular cross-sectioned structures of support brace 146B and hinge pin 201 to pivot therein. Furthermore, connector portion includes a pair of elongate locking slots 228 configured to receive a locking pin 230, which will be discussed in more detail below. Locking slots 228 are preferably substantially parallel to table top 102.

Dual webs 210 and 222 on the first hinge connector 202 and second hinge connector 204 are not required in every embodiment. First hinge connector 202 and second hinge connector 204 could be constructed having single webs 210, 222. In the embodiment where first hinge connector 202 and second hinge connector 204 have single webs 210, 222, it will be appreciated that single apertures 214, 216, 224, 226 and locking slot 228 are provided. Desirably, webs 210, 222 are placed having a tight clearance fit on hinge pin 201.

However, dual, symmetrical webs 210, 222 may be a preferred mode when desired to distribute the torque force along hinge pin 201 so that hinge pin 201 does not experience undue force at a single point. In addition, dual webs 222 having dual locking slots 228 provide a more stable pin configuration. Where dual webs 210, 222 are employed, they preferably have a tight clearance fit when assembled on hinge pin 201.

One way of achieving this is to make webs 210 of first hinge connector 202 spaced apart slightly greater than webs 222 of second hinge connector 204. When assembled on hinge pin 201, webs 222 of second hinge connector 204 will nest within webs 210 of first hinge connector 202 such that there is a close interface between first and second hinge connectors 202, 204.

Another way to achieve this is to have webs 210 of first hinge connector and webs 222 of second hinge connector 204 spaced evenly apart but offset by a few millimeters either to the left or right. When assembled on hinge pin 201, both webs 210 will be disposed on the same side of each of webs 222. This embodiment may be advantageous since substantially the same design can be used for both first and second hinge connectors 202, 204. This embodiment would only require an additional locking slot 228 to be stamped or formed in one of the hinge connectors to distinguish it as the second hinge connector.

Hinge assembly 200 further includes a locking pin 230 which is configured to be disposed in locking slots 228 of second hinge connector 204. Because locking slots 228 are elongate, locking pin 230 is able to slide within locking slots 228. Locking pin 230 and locking slots 228 cooperate with cam portion 212 of first hinge connector 202 to form the locking mechanism which will now be described.

Assembly of hinge assembly 200 includes connecting first hinge connector 202 and second hinge connector 204 to side rails 140A and 140B and/or otherwise connecting first and second hinge connectors 202, 204 to structures of first and second planar portions 106, 108. Apertures 216, 226 of first and second hinge connectors 202, 204 are aligned and an end of hinge pin 201 disposed therethrough. Thus, first and second hinge connectors 202, 204 are disposed about hinge pin 201 in opposing directions. Finally, locking pin 230 is disposed through locking slot 228. Structures of support braces 146A, 146B may also be disposed in apertures 214, 224 of first and second hinge connectors 202, 204.

Figure 10:
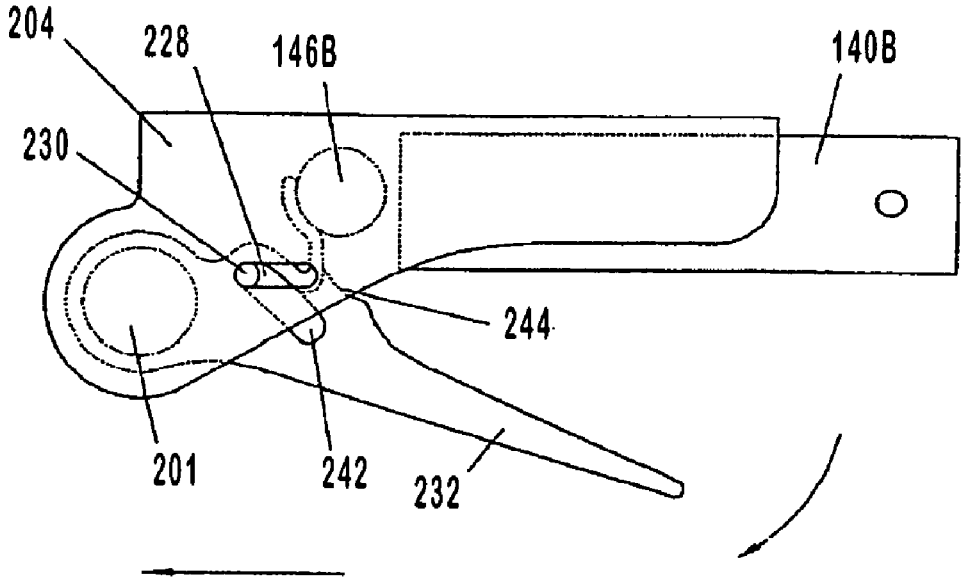
FIG. 10 is a schematic diagram of the hinge assembly of FIG. 8 in the locked position.

In operation, the selective positioning of locking pin 230 within locking slots 228 dictates the status of the locking function, i.e., whether the table top 102 is locked or unlocked in the working position. When reference to FIGS. 10 and 11, the positions of locking pin 230 are illustrated. FIG. 10 illustrates the locked position and FIG. 11 shows the unlocked position.

With reference to FIG. 10, in the locked position, locking pin 230 is displaced closest to the hinge axis 203. With the locking pin 230 in the "locked" position, the cam portion 212 of first hinge connector 202 abuts against locking pin 230. Thus, first hinge connector 202 is unable to rotate in the counter clockwise position (using FIG. 10 as a reference point), which prevents table top 102 from folding together. That is, with cam portion 212 abutting against locking pin 230, side rails 140A, 140B are unable to undergo relative rotary motion. Thus, when hinge assembly 200 is in the "locked" position, table top 102 is level and stable. Hinge assembly 200 can be locked before or after legs 144A, 144B are fully unfolded.

Figure 11:
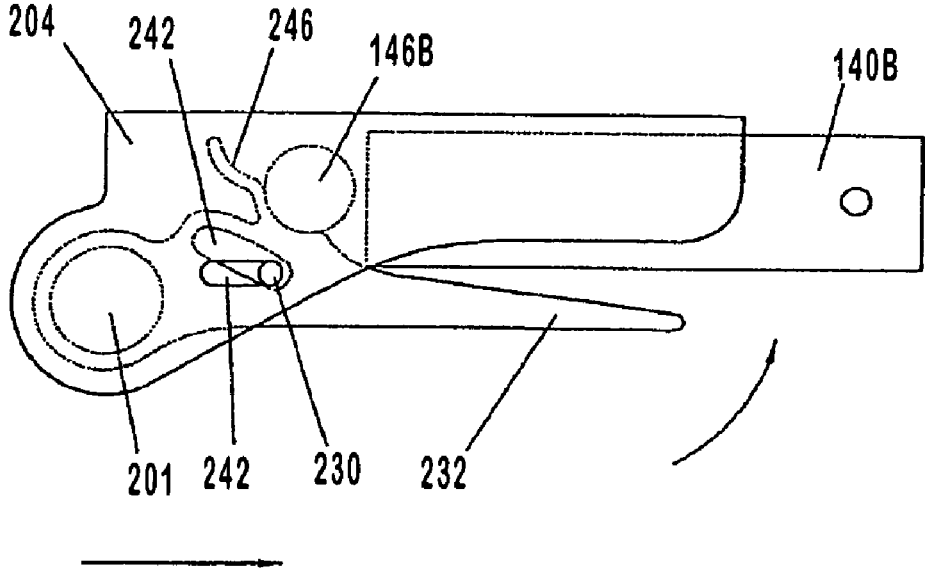
FIG. 11 is a schematic diagram of the hinge assembly of FIG. 8 in the unlocked position.

With reference to FIG. 11, in the unlocked position, locking pin 230 is placed in locking slot 228 in the position farthest away from hinge axis 203. In the unlocked position, cam portion 212 of first hinge connector 202 is not impeded by locking pin 230 such that first hinge connector 202 can freely rotate about hinge axis 203 in both the clockwise and counterclockwise directions. First hinge connector 202 is only impeded by the limit created when the interior edges 118A, 118B of first and second planar portions 106, 108 meet.

In one embodiment, the operation of locking pin 230 can be performed manually. However, because the locking pin 230 is usually small and the space around hinge assembly 200 tight and may present the possibility of pinching fingers, a lock actuating mechanism may be used. An embodiment of lock actuating mechanism 206 is illustrated in FIGS. 6, 8, 9, 10 and 11. Lock actuating mechanism 206 is provided as an additional safety measure and may not be required in some embodiments of the invention.

In one embodiment, lock actuating mechanism 206 comprises a lever 232. As shown in FIG. 9, lever 232 includes at one end a connector portion 234, at the opposing end, a handle portion 236 and an anchoring portion 238 disposed therebetween. Connector portion 234 has an aperture 240 disposed transversely therethrough configured to receive an end of hinge pin 201. Between connector portion 234 and handle portion 236 is an elongate displacement slot 242 corresponding substantially in size and shape to locking slots 228 of second hinge connector 204. When lever 232 is disposed on hinge pin 201 with second hinge pin 204, displacement slot 242 is disposed at an offset angle with respect to locking slot 228 (FIGS. 10 and 11).

The anchoring portion 238 is an elongate structure that extends outwardly from handle portion 236. Anchoring portion 238 includes a first groove 244 and a second groove 246. Grooves 244, 246 are shaped to substantially conform to the outer surface of base portion 172B of support brace 146B.

As shown in FIGS. 10 and 11, and as will be discussed in more detail below, when table top 102 is in a working position, second groove 246 engages base portion 172B of support brace 146B. In contrast, when table top 102 is folded in a storage position, first groove 244 is placed in a position to engage base portion 172B of support brace 146B.

During assembly, lock actuating mechanism 206 may be located within dual webs 210, 222 of first and second hinge connectors 202, 204. In other embodiments where single webs are used, lock actuating mechanism 206 may be placed on either side of the webs so long as locking pin 230 is able to be disposed within locking slots 228 and/or displacement slots 242.

In operation, the displacement slot of 242 of lever 232 functions to move locking pin 230 within locking slot 228, which would otherwise have to be done manually. With reference to FIGS. 10 and 11, lever 232 is shown in the locking position and the unlocked position, respectively. Referring to FIG. 10, when locking pin 230 is in the locked position, it is placed nearest hinge axis 203 in both locking slot 228 and displacement slot 242. To move locking pin 230 into the unlocked position, i.e., in the position farthest away from hinge axis 203, handle portion 236 is operated in the counterclockwise position (using FIGS. 10 and 11 as the reference point). Due to the offset angles of displacement slot 242 and locking slot 228, locking pin 230 is forced to slide along locking slot 228 until it reaches the unlocked position. In the unlocked position, locking pin 230 is positioned farthest from hinge axis 203 in both locking slot 228 and displacement slot 242.

In the reverse direction, i.e., to go from the unlock to locked position, the handle portion 236 of lever 232 is moved in the clockwise direction. The movement of handle 236 and the offset angles of displacement slot 242 and locking slot 228 causes locking pin 230 to slide within locking slot 228 to the locked position.

In addition, when hinge assembly 200 is locked, means are provided for anchoring the lock actuating mechanism 206 so that the lock position is maintained. When the hinge assembly 200 is in the unlocked position (FIG. 10), first groove 244 of anchoring portion 238 engages base portion 172B of support brace 146B. When handle portion 236 is operated in the clockwise direction, it forces base portion 172B to be displaced from first groove 244 and transition to engage second groove 246 of anchoring portion 238. The angle of anchoring portion 238 on lever 232 provides enough resistance and force to prevent base portion 172B from being dislodged so that the locking mechanism is maintained in the locked position. Manual operation of lever 232 is required to provide the force required to disengage base portion 172B from second groove 246.

Hinge assembly 200 may be constructed from any suitable material which provides sufficient strength to the hinge and locking structures. Specifically, first and second hinge connectors 202, 204 are preferably constructed from a high strength metal or plastic. The shapes and apertures required for connectors 202, 204 are easily formed through known manufacturing processes for metals and plastics. Lever 232 is preferably constructed of a high strength metal or plastic through known molding, or injection processes. In particular, anchoring portion 238 of lever 232 is preferably formed from a slightly resilient material which allows anchoring portion 238 to smoothly transition from engaging base portion 172B of support brace 146B in grooves 244 and 246. Depending on the material, the angle of anchoring portion 238 on lever 232 may provide the resilience needed. Locking pin 230 is preferably constructed of a high strength metal or plastic.

V. Two-Stage Folding Mechanism

The operation of the two-stage folding mechanism of table 100 will now be described in detail. FIG. 2 illustrates table 100 of the present invention in a full working position in which table top 102 is in a working position and legs 144A, 144B are in an extended position. Furthermore, in the configuration of FIG. 2, hinge mechanism 200 is preferably in a locked position (FIG. 10) to prevent table top 102 from unexpectedly folding. Preferably, hinging mechanism 200 is maintained in the locked position until table top 102 is ready to be folded to provide the maximum stability when folding legs 144A, 144B.

The first stage of folding involves folding support assembly 104 from an extended position to a folded position. As shown in FIG. 4, when a user is preparing to fold table 100, preferably, the table 100 is turned upside down for easiest access to legs 144A, 144B and hinging mechanism 200. Legs 144A, 144B are positioned from an extended position shown in FIG. 3 to a folded position shown in FIG. 4. This may involve sliding brace rings 180A, 180B along extension portion 174A, 174B of support braces 146A, 146B. Legs 144A, 144B and support braces 146A, 146B fold simultaneously to the folded position shown in FIG. 4.

The second stage of the folding mechanism involves folding table top 102 from a working position to a storage position. The second stage also involves simultaneously folding support assembly 104 so that it compactly fits within table top 102. In the second stage, hinge assembly 200 is placed in the unlocked position (FIG. 11) to allow table top 102 to fold. This may be done manually or using lock actuating mechanism 208 (e.g., lever 232) as described above. In the unlocked position, first hinge connector 202 is able to freely rotate about hinge axis 203, allowing the user to fold first planar portion 106 and second planar portion 108 to the position shown in FIG. 11. This is referred to as the storage position.

As shown in FIG. 11, table 100 has enhanced folding capabilities which decrease the amount of space required for storage. In addition, the compact nature of the storage position in FIG. 5 provides a less wieldy structure which can fit in storage spaces that would otherwise not be useful for conventional folding tables. Such storage spaces include closets, trunks of cars, back seats of cars, and the like. Folding table 100 may be ideal for activities such as camping or traveling which would otherwise not have been possible the conventional folding tables. Furthermore, the compact nature of folded table 100 provides a less wieldy structure than in conventional folding tables. Thus, a single person can easily lift and transport the folded structure shown in FIG. 11.

Advantageously, when the table 100 is folded in its most compact position, hinge pin 203 is exposed so as to provide a handle for carrying the folded table. This increases the transportability of the folding tables of the present invention. Other handle mechanisms may be provided.

Another advantage of the compact folding mechanism of table 100 is that the structures of support assembly 104 are kept entirely within the periphery of portions 106, 108 of table top 102. In this manner, the structures of support assembly 104 are shielded by table top 102 so that they do not present any possibility of catching on other objects or passersby.

To reverse the process, i.e., to unfold table 100 from its compact storage state shown in FIG. 11, first and second planar portions 106, 108 are rotated about hinge axis 203 until the first and second planar portions 106, 108 are on substantially the same plane. Preferably, interior edges 118A, 118B of first and second planar portion 106, 108 provide a limit of rotation. During unfolding of table top 102, hinge assembly 200 is in the unlocked position (FIG. 11). In this position, connector portion 208 of first hinge connector 202 is able to freely rotate about hinge axis 203 in both the clockwise and counterclockwise directions. Locking pin 230 may be manually positioned to the lock position (FIG. 10) which prevents first hinge connector 202 from freely rotating. Alternatively, lever 232 may be operated to displace locking pin 230 to the locked position. With locking pin 230 in the "lock" position, the cam portion 212 of first hinge connector 202 abuts against locking pin 230. Thus, first hinge connector 202 is unable to rotate in the clockwise position, which prevents table top 102 from folding together unexpectedly. In addition, as lever 232 is rotated, engagement of base portion 172B of support brace 146B by first groove 244 is transferred to second groove 246 of anchoring portion 138. Hinge assembly 200 can be locked before or after legs 144A, 144B are fully unfolded, but preferably before legs 144A, 144B are unfolded.

Leg 144A, 144B and support braces 146A, 146B can be unfolded to the extended position as shown in FIG. 3. Bracing rings 180A, 180B may be placed over the intersection of extension portion 174A, 174B and swivel portion 170A, 170B of support braces 146A, 146B to keep the support braces from collapsing. Table 100 is turned right side up to the position shown in FIG. 2.

Although this invention has been described in terms of certain preferred embodiments, other embodiments apparent to those of ordinary skill in the art are also within the scope of this invention. Accordingly, the scope of the invention is intended to be defined only by the claims which follow.

The invention claimed is:

1. A folding table that is movable between a working position and a storage position, the folding table comprising:

a table top including a first portion and a second portion;

a first support assembly connected to the first portion of the table top, the first support assembly being sized and configured to support the first portion of the table top above a surface;

a second support assembly connected to the second portion of the table top, the second support assembly being sized and configured to support the second portion of the table top above a surface; and a hinge assembly connected to the first portion and the second portion of the table top, the hinge assembly being sized and configured to allow the first portion and the second portion of the table top to be moved between the working position and the storage position, the hinge assembly comprising:

a first hinge connector including a body and a connector portion, the body being connected to the first portion of the table top;

a second hinge connector including a body and a connector portion, the body being connected to the second portion of the table top;

a hinge pin disposed through the connector portion of the first hinge connector and through the connector portion of the second hinge connector;

a locking member disposed within an opening in the second hinge connector, the locking member being movable between a locked position and an unlocked position; and a cam portion of the first hinge connector that abuts against the locking member when the locking member is in the locked position to maintain the table top in the working position, the cam portion extending outwardly from the connector portion of the first hinge connector.

2. The folding table as in claim 1, further comprising a locking mechanism that is sized and configured to move the locking member between the locked and unlocked positions.

3. The folding table as in claim 2, wherein the locking mechanism includes a first end and a second end, the locking mechanism further comprising:

a first opening disposed proximate the first end of the locking mechanism, at least a portion of the hinge pin being disposed within the first opening;

a second opening disposed proximate the first end of the locking mechanism, at least a portion of the locking member being disposed within the second opening; and a handle disposed proximate the second end of the locking mechanism, the handle being sized and configured to be grasp by a user.

4. The folding table as in claim 1, further comprising a frame connected to the table top, the frame including a first portion connected to the first portion of the table top and a second portion connected to the second portion of the table top, the first hinge connector being connected to the first portion of the frame and the second hinge connector being connected to the second hinge portion of the frame.

5. The folding table as in claim 1, further comprising a first support brace including a first end connected to the hinge assembly and a second end connected to the first support assembly; and further comprising a second support brace including a first end connected to the hinge assembly and a second end connected to the second support assembly.

6. A folding table that is movable between a working position and a storage position, the folding table comprising:

a table top including a first portion and a second portion;

a hinge assembly including a first portion connected to the first portion of the table top and a second portion connected to the second portion of the table top, the hinge assembly being sized and configured to allow the first portion and the second portion of the table top to be moved between the working position and the storage position;

a hinge pin connecting the first portion of the hinge assembly and the second portion of the hinge assembly;

a locking slot in the second portion of the hinge assembly, the locking slot including a first end disposed towards the hinge pin and a second end disposed away from the hinge pin; and a locking member disposed in the locking slot in the second portion of the hinge assembly, the locking member being selectively movable between a locked position in which the locking member engages the first portion of the hinge assembly and locks the hinge assembly in a first position and an unlocked position in which the first portion of the hinge assembly can rotate relative to the second portion of the hinge assembly and the hinge assembly is unlocked.

7. The folding table as in claim 6, wherein the first portion of the hinge assembly includes an outwardly extending flange with an engaging portion, the engaging portion engaging the locking member when the locking member is in the locked position.

8. A folding table that is capable of being folded between a first position and a second position, the table comprising:

a table top including a first section and a second section;

a first support assembly connected to the first section of the table top;

a second support assembly connected to the second section of the table top; and a hinge assembly interconnecting the first section of the table top and the second section of the table top, the hinge assembly being sized and configured to allow the table to be moved between the first position and the second position, the hinge assembly including a locked position and an unlocked position, the hinge assembly comprising:

a first hinge portion connected to the first section of the table top, the first hinge portion including a connector portion with an aperture;

a second hinge portion connected to the second section of the table top, the second hinge portion including a connector portion with an aperture;

a hinge pin extending through the aperture in the connector portion of the first hinge portion and the aperture in the connector portion of the second hinge portion to connect the first hinge portion of the hinge assembly and the second hinge portion of the hinge assembly;

a locking member movable relative to the second hinge portion of the hinge assembly between a locked position and an unlocked position;

an engaging portion the first hinge portion of the hinge assembly, the engaging portion engaging the locking member when the locking member is in the locked position, the engaging portion being spaced apart from the locking member when the locking member is in the unlocked position to allow the table to be moved between the first position and the second position; and a lock actuating mechanism that moves the locking member between the locked position and the unlocked position, the lock actuating mechanism including an aperture and the hinge pin extending through the aperture to connect the lock actuating mechanism to the hinge assembly.

9. The folding table as in claim 8, wherein the lock actuating mechanism is movable between a first position in which the locking member is in the locked position and a second position in which the locking member is in the unlocked position.

10. The folding table as in claim 8, further comprising a displacement slot in the lock actuating mechanism, the locking member being disposed in the displacement slot.

11. The folding table as in claim 10, wherein the lock actuating mechanism includes a first end and a second end, the aperture being disposed at least proximate the first end of the lock actuating mechanism, the lock actuating mechanism further comprising a handle disposed proximate the second end of the locking mechanism, the handle being sized and configured to be grasp by a user.

12. The folding table as in claim 8, further comprising a frame connected to the table top, the frame including a first portion connected to the first portion of the table top and a second portion connected to the second portion of the table top, the first hinge connector being connected to the first portion of the frame and the second hinge connector being connected to the second hinge portion of the frame.

13. The folding table as in claim 8, further comprising a first support brace including a first end connected to the hinge assembly and a second end connected to the first support assembly; and further comprising a second support brace including a first end connected to the hinge assembly and a second end connected to the second support assembly.

14. The folding table as in claim 8, further comprising a frame connected to the table top, the frame including a first pair of side rails connected to the first portion of the table top and a second pair of side rails connected to the second portion of the table top; further comprising a first hinge assembly with a first hinge portion connected to one of the first pair of side rails of the frame and a second hinge portion connected to one of the second pair of side rails of the frame; and further comprising a second hinge assembly with a first hinge portion connected to the other of the first pair of side rails of the frame and a second hinge portion connected to the other of the second pair of side rails of the frame.

15. The folding table as in claim 14, wherein a single hinge pin connects the first hinge portion and the second hinge portion of the first hinge assembly, and connects the first hinge portion and the second hinge portion of the second hinge assembly.

16. The folding table as in claim 14, further comprising a first support brace including one end connected to the first hinge assembly and the second hinge assembly, and another end connected to the first support assembly; and further comprising a second support brace including one end connected to the first hinge assembly and the second hinge, and another end connected to the second support assembly.

17. A table comprising:

a table top including a first table top section and a second table top section, the table top being positionable between a folded position and unfolded position;

a table frame connected to the table top and including a first side rail, the first side rail including:

a first elongated rail portion; and a second elongated rail portion;

a hinge assembly pivotally interconnecting the first rail portion and the second rail portion and being positionable between a first position in which table top is positioned in the folded position and a second position in which the table top is position in the unfolded position, the hinge assembly including:

a first connector including:

a first flange including a first cam portion; and a second flange including a second cam portion;

a second connector including:

a third flange disposed at least partially between the first and second flanges; and a fourth flange disposed at least partially between the first and second flanges; and a pivot pin pivotally connecting the first, second, third, and fourth flanges;

a locking pin movable among a plurality of positions; and a lever disposed at least partially between the first and second flanges, disposed at least partially between the third and fourth flanges, and pivotally connected to the pivot pin; the lever being sized and configured to guide the locking pin among a plurality of positions, including a first position in which the locking pin engages the first cam portion and the second cam portion and a second position in which the locking pin is spaced apart from the first cam portion and the second cam portion.

18. A table as recited in claim 17, wherein the lever includes a first aperture, the third flange includes a second aperture, and the fourth flange includes a third aperture and wherein the locking pin is at least partially disposed within each of the first, second, and third apertures.

19. A table as recited in claim 17, wherein the lever includes a first elongated aperture having a pair of opposing rounded ends, the third flange includes a second elongated aperture having a pair of opposing rounded ends, and the fourth flange includes a third elongated aperture having a pair of opposing rounded ends and wherein the locking pin is at least partially disposed within each of the first, second, and third elongated apertures.

20. A table as recited in claim 19, wherein the locking pin is disposed proximate one of the opposing ends of the first elongated aperture when the locking pin is in the first position; wherein the locking pin is disposed proximate the other opposing end of the first elongated aperture when the locking pin is in the second position; wherein the locking pin is disposed proximate one of the opposing ends of the second elongated aperture when the locking pin is in the first position; and wherein the locking pin is disposed proximate the other opposing end of the second elongated aperture when the locking pin is in the second position.

21. A table as recited in claim 17, wherein the lever further comprises an anchoring portion including a first receiving portion and a second receiving portion.

22. A table as recited in claim 21, wherein the first receiving portion comprises a first groove having a generally concave configuration and the second receiving portion comprises a second groove having a generally concave configuration.

23. A table comprising:

a table top including a first table top section and a second table top section, the table top being positionable between a folded position and unfolded position;

a table frame including:

a first rail portion; and a second rail portion;

a hinge assembly pivotally interconnecting the first rail portion and the second rail portion and being positionable between a first position in which table top is positioned in the folded position and a second position in which the table top is position in the unfolded position, the hinge assembly including:

a first connector; and a second connector pivotally connected to the first connector;

a locking pin movable among a plurality of positions, including a first position in which the locking pin releasably locks the hinge assembly when the table top is position in the unfolded position; and a lever including an aperture, the locking pin being disposed within the aperture;

wherein movement of the lever results in movement of the locking pin relative to the aperture; and wherein an inner surface of the aperture engages the locking pin and moves the locking pin among the plurality of positions when the lever is being moved.

24. A table as recited in claim 23, wherein the lever further comprises an anchoring portion including a first receiving portion and a second receiving portion.

25. A table as recited in claim 24, wherein the first receiving portion comprises a first groove having a generally concave configuration and the second receiving portion comprises a second groove having a generally concave configuration.

26. A table comprising:

a table top including a first table top section and a second table top section, the first table top section and the second table top section being constructed from blow-molded plastic and including an upper surface, a lower surface and a hollow interior portion that are integrally formed during the blow-molding process; the first table top section and the second table top being positionable between a folded position and unfolded position;

a table frame including:

a first metal rail connected to the first table top section; and a second metal rail connected to the second table top section;

a hinge assembly pivotally interconnecting the first rail and the second rail of the table frame, the hinge assembly comprising:

a first hinge connector connected to the first rail;

a second hinge connector connected to the second rail;

a hinge pin connecting the first hinge connector and the second hinge connector;

a locking slot in the second hinge connector;

a locking pin movable within the locking slot being a locked position and an unlocked position; and an engaging member of the first hinge connector that engages the locking pin when the locking pin is in the locked position, the engaging member being spaced apart from the locking pin is in the unlocked position; and a lever that is movable between a first position and a second position, the lever including an engaging surface that engages the locking pin to move the locking pin between the locked position and the unlocked position.

27. A table as recited in claim 26, further comprising an aperture in the lever, the engaging surface forming at least a portion of an inner surface of the aperture.

* * * * *

UNITED STATES PATENT AND TRADEMARK OFFICE

CERTIFICATE OF CORRECTION

PATENT NO. : 7,475,641 B2 
APPLICATION NO. : 10/616800
DATED : January 13, 2009
INVENTOR(S) : Jin It is certified that error appears in the above-identified patent and that said Letters Patent is hereby corrected as shown below:

Drawing

Sheet 4, Please replace the current drawing of Figure 6 with the figure depicted below in which the "bracing ring 180A" has been labled.

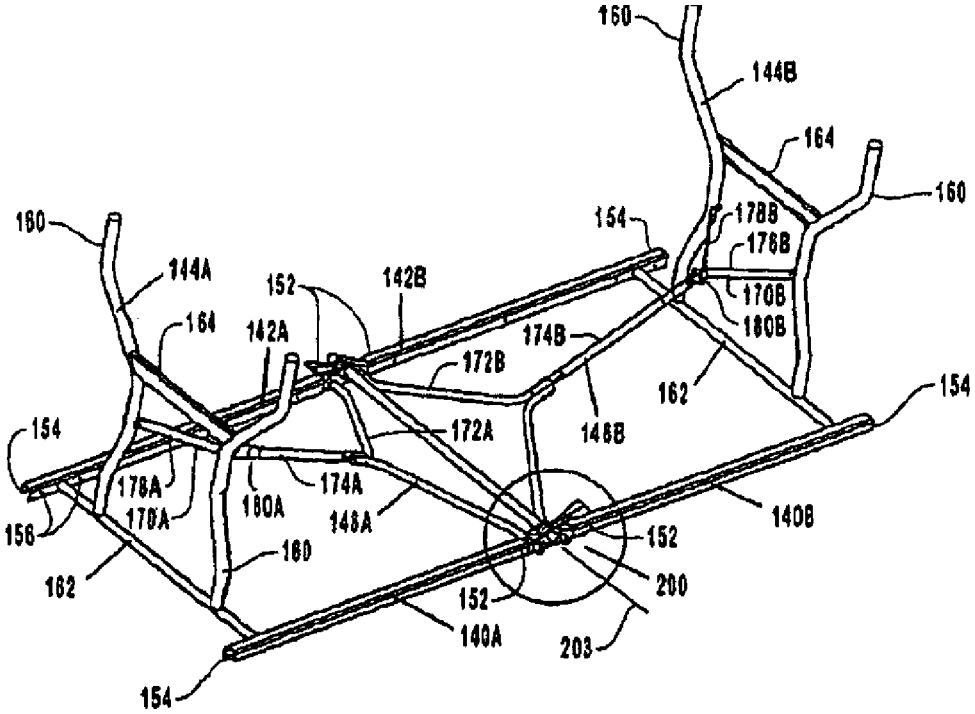

Fig. 6

UNITED STATES PATENT AND TRADEMARK OFFICE

CERTIFICATE OF CORRECTION

PATENT NO. : 7,475,641 B2
APPLICATION NO. : 10/616800
DATED : January 13, 2009
INVENTOR(S) : Jin It is certified that error appears in the above-identified patent and that said Letters Patent is hereby corrected as shown below:

Column 1
Line 37, before "a pair" insert --consists of--

Column 5
Line 28, delete "a" after "of"

Column 7
Line 65, change "bold" to --hold--

Column 9
Line 44, change "104" to --104,--
Line 45, change "position" to --position,--

Column 10
Line 19, change "embodiment" to --embodiments--
Line 22, change "embodiment" to -- embodiments--

Column 11
Line 28, change "siderails" to --side rails--

Column 14
Lines 50, 51, and 64, change "FIG. 11" to --FIG. 5--
Line 60, before "the" insert --with--
Line 66, change "203" to --201--

UNITED STATES PATENT AND TRADEMARK OFFICE

CERTIFICATE OF CORRECTION

PATENT NO. : 7,475,641 B2
APPLICATION NO. : 10/616800
DATED : January 13, 2009
INVENTOR(S) : Jin It is certified that error appears in the above-identified patent and that said Letters Patent is hereby corrected as shown below:

Column 15
Line 11, change "FIG. 11" to --FIG. 5--

Column 17
Line 38, change "the" to --disposed in the--

Column 20
Line 40, change "being" to --between--
Line 41, change "and" to --or--
Line 45, delete "is"

Signed and Sealed this

Twentieth Day of October, 2009

David J. Kappos

David J. Kappos
*Director of the United States Patent and Trademark Office*